United States Patent [19]

Shiromoto et al.

[11] Patent Number: 4,944,932

[45] Date of Patent: Jul. 31, 1990

[54] PROCESS FOR PRODUCING CARBON FIBER

[75] Inventors: Keigo Shiromoto; Yasuo Adachi; Kiyoyuki Nabae, all of Iyo, Japan

[73] Assignee: Toray Industries Inc., Tokyo, Japan

[21] Appl. No.: 251,972

[22] Filed: Sep. 30, 1988

Related U.S. Application Data

[63] Continuation-in-part of Ser. No. 942,650, Dec. 17, 1986, abandoned.

[30] Foreign Application Priority Data

Dec. 27, 1985 [JP] Japan ..... 60-292815

[51] Int. Cl.[5] ..... D01F 9/12

[52] U.S. Cl. ..... 423/447.6; 423/447.1; 423/447.2; 423/447.4; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 4,080,417 | 3/1978 | Kishimoto et al. | 264/29.2 |
| 4,259,307 | 3/1981 | Maruyama | 423/447.6 |
| 4,349,523 | 9/1982 | Hiramatsu et al. | 423/447.2 |
| 4,496,631 | 1/1985 | Adachi et al. | 423/447.2 |

FOREIGN PATENT DOCUMENTS

| | | | |
|---|---|---|---|
| 0102705 | 3/1984 | European Pat. Off. | 423/447.2 |
| 61-28074 | 2/1986 | Japan | 423/447.1 |
| 61-119772 | 6/1986 | Japan | 423/447.6 |

*Primary Examiner*—John Doll
*Assistant Examiner*—Robert M. Kunemund
*Attorney, Agent, or Firm*—Armstrong, Nikaido, Marmelstein, Kubovcik & Murray

[57] ABSTRACT

A process for producing an acrylic carbon fiber comprising the steps of applying an oiling agent comprising as its indispensable component a neopentyl alcohol derivative represented by the following general formula (I) to acrylic fiber, heating the lubricated acrylic fiber in an oxidizing atmosphere to convert the same into oxidized fiber, and heating the oxidized fiber in an inert atmosphere at a higher temperature to carbonize the same:

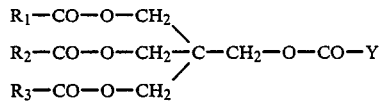

(I)

The process can eliminate the defects of acrylic fiber precursor and provide a carbon fiber having excellent mechanical strength characteristics.

3 Claims, No Drawings

PROCESS FOR PRODUCING CARBON FIBER

This application is a continuation-in-part of application Ser. No. 942,650 filed Dec. 17, 1986, now abandoned.

BACKGROUND

The present invention relates to a process for preparing a high quality carbon fiber having a high strength by using an acrylic fiber as the precursor.

Carbon fibers have heretofore been widely used as reinforcing fibers of various composite materials due to their superior mechanical strength characteristics such as excellent specific strength and specific elasticity. In production of a high-grade carbon fiber having an especially high strength among others, an acrylic fiber is usually used as the precursor in a generally adopted process comprising the steps of heating an acrylic fiber in an oxidizing atmosphere at a temperature of about 200° to 400° C. to oxidize the same for conversion thereof into an oxidized fiber (flame-retardant fiber), and heating the resulting fiber in an inert atmosphere of nitrogen, helium, argon, or the like at a temperature of about 400° C. or higher to carbonize the same. Thus, acrylic fiber precursor is subjected to a very severe thermal treatment during the course of conversion thereof into a carbon fiber.

More specifically, it is believed that acrylic fiber precursor is converted into a fiber having a thermally stabilized molecular structure as a result of cyclization and crosslinking reactions of polymer chains constituting the acrylic fiber in the above-mentioned oxidizing step, while at the same time adherent substances included in the fiber, such as a oiling agent, are evaporated and thermally decomposed, followed by polymerization of the resulting thermal decomposition product into a tar-like substance. Not only fusion of filaments constituting a fiber bundle among each other but also surface and inside defects of the filaments themselves are caused by the reactions of the polymer chains constituting the fiber and the thermal decomposition of the adherent matters included in the fiber, such as an oiling agent. Such fusion and defects drastically deteriorate the physical properties of the carbon fiber. Thus, prevention or suppression of such fusion and defects is very important in the industrial production of carbon fibers.

Against the above-mentioned problem peculiar to the production of a carbon fiber, a number of proposals have been made of the use of an organosilicon compound as an oiling agent for an acrylic fiber with a view to suppressing the fusion of filaments among each other in the process for production of a carbon fiber, particularly in the oxidizing step.

However, the use of such an organosilicon oil involves a problem of worsening of a working environment and causing pollution since the oligomer and terminal molecular chain of the organosilicon oil are decomposed and evaporated at high temperature and further decomposed into silicon dioxide in the process for production of a carbon fiber, with the result that a gas exhaust unit is clogged, while dust heaps up. Further, since the organosilicon does not always satisfy the performance required of a processing or finishing oil for an acrylic fiber by itself, it is not usually used alone but in combination with other processing or finishing oil. In this respect, however, the effect of suppressing fusion of the filaments among each other by the organosilicon oil is ruined through it depends on the combined oil, or the defects of the carbon fiber are caused by a tar-like substance converted from the combined oil in the above-mentioned oxidizing and carbonizing steps, thus presenting a problem.

SUMMARY OF THE INVENTION

An object of the present invention is to provide a process for producing a carbon fiber excellent in mechanical strength characteristics, which can eliminates the defects caused in individual filaments constituting an acrylic fiber as the precursor of the carbon fiber by improving an oil agent.

Another object of the present invention is to provide a process which can produce acrylic fiber precursor which can be readily bundled without causing fiber disorder or fluffing and which is free from fusion of filaments in an industrially advantageous manner.

The objects of the present invention can be attained by a process comprising the steps of applying an oiling agent comprising as the indispensable component a neopentyl alcohol derivative represented by the following general formula (I) to acrylic fiber, heating the lubricated acrylic fiber in an oxidizing atmosphere to convert the same into oxidized fiber bundles, and heating the oxidized fiber in an inert atmosphere of a higher temperature to carbonize the same:

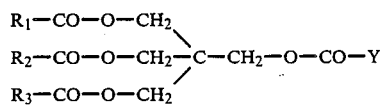

(I)

[wherein $R_1$, $R_2$, and $R_3$ are each an alkyl group having 1 to 12 carbon atoms, and Y is an alkyl group having 1 to 12 atoms or

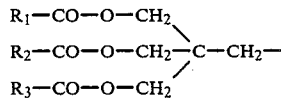

(wherein $R_1$, $R_2$, and $R_3$ are each an alkyl group having 1 to 12 carbon atoms)].

The use of the above-mentioned specific oiling agent as the one for application thereof to the fiber precursor can prevent not only voids formation inside filaments, heterogeneity of the texture, fusion of filaments among each other, mechanical damages, etc., which are caused in the step of producing a precursor, but also fusion of filaments among each other in the step of heating the precursor at high temperature for burning of the same. In this way, a carbon fiber having very excellent mechanical strength characteristics can be obtained.

DETAILED DESCRIPTION OF THE INVENTION

According to the studies of the inventors of the present invention, in addition to smoothness, antistatic properties, and capability of bundling required of an oiling agent used in the production of common synthetic fibers, the following performance characteristics are very important for an oiling agent used for acrylic fiber in the production of a carbon fiber:

(1) the oiling agent should not permeate into filaments constituting an acrylic fiber for avoiding fusion of filaments among each other in the step of producing acrylic fiber, and provide uniform application thereof to the surface of the filaments;

(2) the oiling agent should have a thermal resistance enough to resist heating in the ordinary oxidizing step without forming tar-like substance, as well as an excellent releasability; and (3) in the case of the combined use of the oiling agent with an organosilicon oil for the purpose of improving the above-mentioned releasability, the oiling agent should be able to guarantee an industrially stable operating efficiency without detriment to uniform oil film formation of the organosilicon oil on the surface of filaments and without reducing the capability of bundling of the acrylic fiber. The above-mentioned performance characteristics can be achieved by using the above-mentioned oiling agent according to the present invention.

Although the organosilicon oil is effective in preventing fusion of filaments among each other because of its excellent thermal resistance and releasability, enormous facilities and expense are needed in the treatment of an exhaust gas containing a decomposition product of the organosilicon formed in the burning steps involving oxidation and carbonization. When fusion occurs prior to application of an organosilicon oil in the process for production of acrylic fiber, the organosilicon oil is not effective in eliminating the fusion or preventing damages to the filament surfaces by peeling of fused portions, while no effect can be expected in preventing void formation inside the filaments.

Neopentyl alcohol derivatives represented by the formula (I) that can be used in the present invention include neopentyl polyol compounds having an alkyl group with 1 to 12 carbon atoms in a side chain thereof, such as trimethylolpropane octanate, pentaerythritol tetralaurate, and dipentaerythritol hexanate.

Further, specific examples include neopentyl glycol dihexanate represented by the formula:

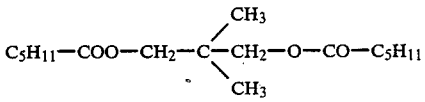

neopentyl glycol didodecanate represented by the formula:

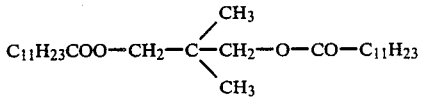

trimethylolethane octanate represented by the formula:

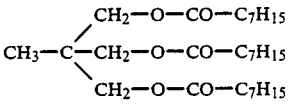

trimethylolpropane trinonanate represented by the formula:

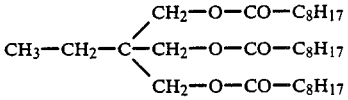

pentaerythritol tetraoctanate represented by the formula:

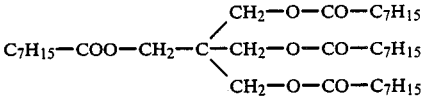

pentaerythritol didodecanate dihexanate represented by the formula:

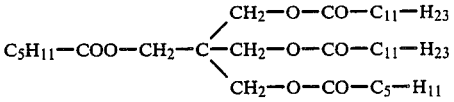

dipentaerythritol hexahexanate represented by the formula:

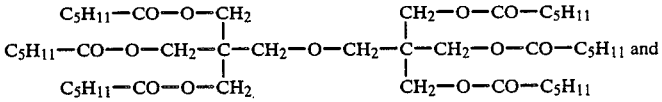

dipentaerythritol hexaoctanate represented by the formula:

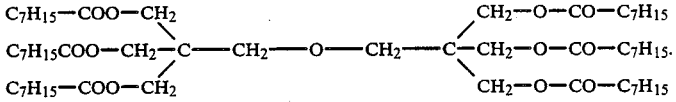

When the side chain of the compound as mentioned above is an alkyl group with 13 or more carbon atoms, the amount of heating residue is disadvantageously increased too much.

Although a neopentyl alcohol derivative alone may be used as the oiling agent comprising such a neopentyl alcohol derivative as the indispensable component, a combination thereof with a straight chain organosilicone represented by the following formula (II) such as an amino-modified polysiloxane, a polyether-modified polysiloxane, or an epoxy-modified polysiloxane is preferably used. Such a combination serves to highly satisfying properties required of the oiling agent for acrylic fiber as the raw material of a carbon fiber.

(II)

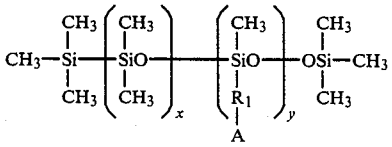

[wherein $R_1$ is an alkylene group having 5 or less carbon atoms or an aryl group, x is an integer of 10 to 1000, y is an integer of 1 to 20, A is

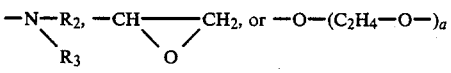

(wherein $R_2$ is hydrogen or an alkylene group having 5 or less carbon atoms, $R_3$ is hydrogen or an alkylene or aminoalkyl group each having 5 or less carbon atoms, and a is an integer of 1 to 50)].

Examples of the above-mentioned amino-modified siloxane, polyether-modified polysiloxane, and epoxy-modified polysiloxane include amino-modified polysiloxanes (molecular weight: about 20,000) containing about 0.7% of primary amino groups and represented by the following formula:

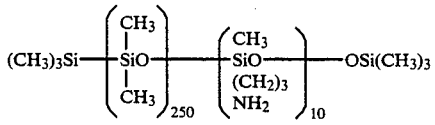

amino-modified polysiloxanes (molecular weight: about 8,000) containing primary and secondary amino groups (amino group content: about 0.7%) and represented by the following formula:

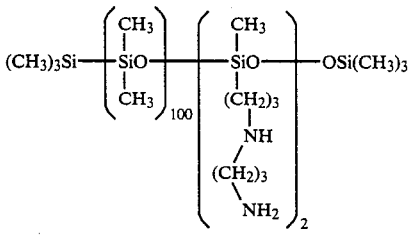

epoxy-modified polysiloxanes (molecular weight: about 50,000) containing an epoxy content of about 1% and represented by the following formula:

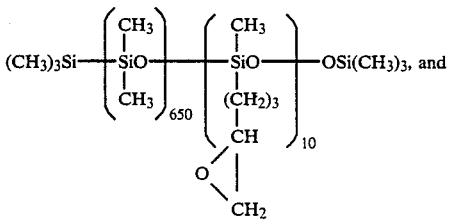

polyether-modified polysiloxanes (molecular weight: about 18,000) containing 10% of polyether groups and represented by the following formula:

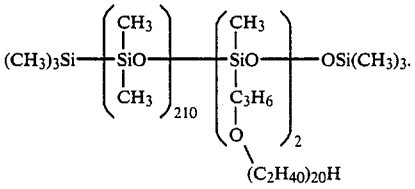

Even when such other component is combined, the neopentyl alcohol derivative should be used in an amount of from 20 to 90% by weight, preferably 40 to 80% by weight, based on all components of an oiling agent. The amount of the oiling agent to be applied to acrylic fiber is desirably about 0.5 to 10% by weight based on the fiber weight. The amount of the above-mentioned modified organopolysiloxane is desirably 10 to 80 wt.% based on the oiling agent.

The acrylic fiber used in the present invention is composed of an acrylic polymer or copolymer containing an acrylonitrile (hereinafter referred to briefly as "AN") as the main component.

Examples of such an acrylic fiber include not only fibers made of AN homopolymer, but also fibers respectively made of acrylic copolymer of at least 90 mol% of AN and less than 10 mol% of a vinyl compound copolymerizable with AN, such as acrylic acid, methacrylic acid, itaconic acid, a lower alkyl ester of one of the above-mentioned vinyl compounds, acrylamide, methacrylamide, N-methylolacrylamide, methyl vinyl ketone, hydroxyacrylonitrile, acrolein, methacrolein, allylsulfonic acid, methallylsulfonic acid, styrenesulfonic acid, or a metallic salt of one of the last three vinyl compounds.

A process for producing acrylic fiber comprises the steps of spinning a spinning solution of an AN polymer as mentioned above in a solvent therefor according to the known wet, dry or dry-jet wet process, and subjecting the resulting coagulated filaments to the steps including drawing, water-washing, and drying to form a fiber. In this process, low-velocity spinning, multistep drawing, etc. are favorably adopted for the purpose of obtaining a denser fiber.

In this process for producing acrylic fiber, the above-mentioned oiling agent may be used as a processing oil in the steps succeeding water washing and drawing, or as a finishing oil after drying. It may also be used after forming fiber. When it is used as the processing oil, it is desired to comprise a combined oil component selected from among those having antistatic properties, such as nonylphenol, cationic oil, and fatty acid esters, and those capable of providing smoothness, such as wax and adducts of a higher alcohol with ethylene oxide. When it is used as the finishing oil, it is desired to comprise a mineral oil, an adduct of an higher alcohol with ethylene oxide, or a neutral oil for providing a uniform applicability in addition to one having antistatic properties and one capable of providing smoothness.

The neopentyl alcohol derivative as the indispensable component of the oiling agent to be used in the process of the present invention has an excellent performance in respect of thermal resistance, amount of heating residue, amount of heat generation, and degree of densification of the resulting fiber, etc. Therefore, it exhibits very excellent effects of preventing acrylic fiber precursor for production of a carbon fiber from undergoing fusion of filaments among each other in the oxidizing and carbonizing steps and preventing the resulting carbon fiber from involving defects on the surface and inside thereof. Furthermore, since it has properties required of both processing and finishing oils, the process can be simplified due to non-necessity for the step of application of any finishing oil when it is used as the processing oil.

The following Examples will more specifically illustrate the present invention.

In the Examples, the degree of permeation into a fiber and the degree of fusion of fiber bundles were examined according to the following respective methods.

Degree of Permeation into Fiber (Denseness)

Evaluation is made in terms of heterogeneity attributable to permeation of an oiling agent into the inside of a fiber. More specifically, a raw filament is dyed with an iodine solution (prepared by diluting 50.76 g of $I_2$, 10 g of 2,4-dichlorophenol, 90 g of acetic acid, and 100 g of potassium iodide (KI) with 1l of water to a predetermined volume). The hue of the fiber is measured before and after dyeing and a difference in hue therebetween is used to represent the heterogeneity. The larger the hue difference, the larger the heterogeneity up to the inside of the fiber (i.e., the fiber is dyed deep inside of the fiber with $I_2$).

Degree of Fusion

Filaments of an acrylic fiber bundle are cut to a length of 5 mm and dispersed in a 0.1% aqueous solution of a surface-active agent stirred with a controlled stirrer, followed by suction filtration and recovery of filaments. Estimation is made in terms of the number of fused fiber filaments according to the following rating:

the number of fused filaments of 5 or more: x
the number of fused filaments of 2 or 4: o
the number of fused filaments of 1 or less: ◎

EXAMPLES 1 TO 4 AND COMPARATIVE EXAMPLES 1 TO 6

A 19.5% dimethyl sulfoxide (DMSO) solution of an acrylonitrile copolymer composed of 99.7 mol% of AN and 0.3 mol% of itaconic acid as the spinning solution was spun through a 0.006 mm spinneret into a coagulating bath containing a 55% aqueous DMSO solution as the coagulating agent. The resulting filaments were sufficiently washed with warm water to 40° to 65° C., drawn in hot water of 75° to 98° C., and dipped in each one of various oiling agents as listed in Table 1 to apply the same to the filaments, followed by drying to densify the same. Thus, acrylic fiber were prepared.

The acrylic fiber showed a degree of fusion of filaments among each other as listed in Table 1.

The acrylic fiber was fed to a step of ordinary treatment at 245° C. for imparting a flame resistance to the same and then carbonized in a carbonizing furnace filled with a nitrogen atmosphere maintained at 1400° C.

The strand strength and bundle tenacity of the resulting carbon fiber were measured. The results are shown in Table 2.

It will be understood from Table 1 that acrylic fiber prepared using oiling agents according to the present invention, namely oiling agents comprising neopentyl alcohol derivatives and modified polysiloxane, showed a very little permeation of the oiling agent into the inside of the filaments thereof and were prevented from fusion of the filaments in the steps after application of the oiling agent, thus substantiating uniform application of the oiling agent all over the surfaces of the filaments.

It will be understood from Table 2 that carbon fibers produced from acrylic fiber according to the present invention were remarkably superior in strand strength and bundle tenacity to those produced using a higher alcohol or polybutene in Comparative Example as oiling agent.

When more than 80 wt.% of a surface-active agent was blended with an oiling agent according to the present invention as shown in Table 1, the permeation of the oiling agent into the inside of filaments were increased as is apparent from the amount of $I_2$ (iodine) adsorption and the strength of the resulting carbon fiber was decreased as shown in Table 2. On the other hand, it will be understood that, when less than 10 wt.% of a surface-active agent was blended, the dispersibility of the neopentyl alcohol derivatives/modified polysiloxane the indispensable component of the oiling agent according to the present invention was so lowered that uniform application of the oiling agent to the surfaces of the fiber filaments was hampered, leading to reduction in the effect of preventing the fusion.

Surprisingly, further, it is clearly seen with reference to Tables 1 and 2 that in comparison to many of such other oiling agents as represented in the Comparative Examples, the oiling agents according to the invention incorporating a modified polysiloxane are exceedingly effective in suppressing the generation of static electricity and in obtaining a remarkable bundling capability in the process of producing acrylic fiber yarn and in the oxidation step, and can serve to provide carbon fibers having a highly desirable mechanical strength.

Table 3, which is shown below, enters heat resistance values of main ingredients of oiling agents used the in Examples and Comparative Examples.

TABLE 1

| Kind of Oiling Agent (Compounding Ratio) | | Antioxidant (wt. %) | Amount of Adhering Oiling Agent (wt. %) | Degree of Permeation into Filament | Degree of Precursor Fusion | Degree of Static Electricity Generation | Bundling Capability |
|---|---|---|---|---|---|---|---|
| Example | | | | | | | |
| dipentaerythritol hexaluarate (50%) amino-modified polysiloxane (50%) | nonylphenol EO adduct | | | | | | |
| (wt. %) | (wt. %) | | | | | | |
| 95 | 5 | none | 3 | 35 | Δ | slight | good |
| 90 | 10 | none | 3 | 36 | ○ | slight | good |
| 70 | 30 | none | 3 | 38 | ◎ | slight | good |
| 50 | 50 | none | 3 | 45 | ◎ | slight | good |
| 20 | 80 | none | 3 | 50 | ◎ | slight | good |
| 10 | 90 | none | 3 | 59 | X | slight | filament |

TABLE 1-continued

| Kind of Oiling Agent (Compounding Ratio) | | Antioxidant (wt. %) | Amount of Adhering Oiling Agent (wt. %) | Degree of Permeation into Filament | Degree of Precursor Fusion | Degree of Static Electricity Generation | Bundling Capability |
|---|---|---|---|---|---|---|---|
| | | | | | | | disorder |
| Example 2 | | | | | | | |
| dipentaerythritol hexaluarate/amino-modified xane | polysilo-EO adduct | nonylphenol | | | | | |
| 70 (wt. %) | 30 (wt. %) | | | | | | |
| (100/0)* | | none | 3 | 35 | Δ | slight | good |
| (95/5)* | | none | 3 | 38 | ○ | slight | good |
| (90/10)* | | none | 3 | 40 | ⊙ | slight | good |
| (75/25)* | | none | 3 | 45 | ⊙ | slight | good |
| (50/50)* | | none | 3 | 50 | ⊙ | slight | good |
| (0/100)* | | none | 3 | 55 | Δ | much | filament disorder |
| Example 3 | | | | | | | |
| dipentaerythritol tetraoctanate (50%)/amino-modified polysilo-xane | nonylphenol EO adduct | | | | | | |
| (wt. %) | (wt. %) | | | | | | |
| 90 | 10 | none | 3 | 33 | ○ | slight | good |
| 70 | 30 | none | 3 | 35 | ⊙ | slight | good |
| 50 | 50 | none | 3 | 43 | ⊙ | slight | good |
| 20 | 80 | none | 3 | 47 | ⊙ | slight | good |
| 10 | 90 | none | 3 | 55 | Δ | slight | filament disorder |
| Example 4 | | | | | | | |
| dipentaerythritol tetraoctanate (75%)/modified silicon compo-sition | nonylphenol EO adduct | | | | | | |
| (wt. %) | (wt. %) | | | | | | |
| 80 | 20 | none | 1.5 | 35 | ○ | slight | good |
| 80 | 20 | none | 3 | 40 | ⊙ | slight | good |
| Comparative Example 1 | | | | | | | |
| stearyl alcohol $EO_{20}$ adduct | | | | | | | |
| 100 (wt. %) | none | none | 3 | 60 | X | slight | fluffing frequent |
| Comparative Example 2 | | | | | | | |
| stearyl alcohol $EO_{20}$ adduct (80%)/ amino-modified polysiloxane (20%) | nonylphenol EO adduct | | | | | | |
| (wt. %) | (wt. %) | | | | | | |
| 80 | 20 | none | 3 | 55 | Δ | slight | filament disorder |
| 80 | 20 | none | 5 | 58 | ○ | slight | filament disorder |
| Comparative Example 3 | | | | | | | |
| stearyl alcohol $EO_{20}$ adduct (50%)/ amino-modified polysiloxane (40%) | none | di(nonylpheny)-dinonylphenyl phosphite (10%) | 2.5 | 52 | Δ | slight | filament disorder |
| Comparative Example 4 | | | | | | | |
| isopentacosanyl alcohol $EO_{20}$ aduct (70%)/ amino-modified polysiloxane (25%) | none | di(nonylpheny)-dinonylphenyl phosphite (5%) | 2.6 | 53 | Δ | slight | filament disorder |
| Comparative Example 5 | | | | | | | |
| oleyl alcohol $EO_{20}$ adduct (70%)/ amino-modified polysiloxane (25%) | none | tetrakis[methylene-3(3,5-di-tert-butyl-4-hydroxy-phenyl)propionate] methane (5%) | 2.5 | 51 | Δ | slight | filament disorder |
| Comparative Example 6 | | | | | | | |
| polybutane | none | none | 3.0 | 40 | X | much | fluffing |

TABLE 1-continued

| Kind of Oiling Agent (Compounding Ratio) | Antioxidant (wt. %) | Amount of Adhering Oiling Agent (wt. %) | Degree of Permeation into Filament | Degree of Precursor Fusion | Degree of Static Electricity Generation | Bundling Capability |
|---|---|---|---|---|---|---|
| | | | | | | frequent |

Notes:
* = compounding ratios (by weight) of dipentaerythritol hexalaurate to amino-modified polysiloxane
** = equivalent mixtures of amino-modified silicone, EO-modified silicone and epoxy-modified silicone

TABLE 2

| Composition of Oiling Agent (wt. %) | Antitoxidant (wt. %) | Adhering Amount of Oiling Agent (wt. %) | Evaluation of Tar Attachment | Strand Strength (kg/mm$^2$) | Strength of Bundle (kg) |
|---|---|---|---|---|---|
| Example 1: | | | | | |
| dipentaerythritol hexalaurate (35%)/ | none | 1.0 | no | | |
| aminomodified poly-siloxane (35%)/ | none | 2.5 | no | 455 | 45 |
| nonylphenol EO adduct (30%) | none | 5.0 | no | | |
| Example 2: | | | | | |
| dipentaerythritol hexalaurate/amino-modified polysilo-xane (70%)/nonyl-phenol EO (30%) | adduct | | | | |
| 100/0* | none | 3 | no | 380 | 28 |
| 95/5* | none | 3 | no | 380 | 30 |
| 90/10* | none | 3 | no | 420 | 40 |
| 75/20* | none | 3 | no | 460 | 45 |
| 50/50* | none | 3 | no | 440 | 45 |
| 0/100* | none | 3 | no | 390 | 45 |
| Example 3: | | | | | |
| pentaerythritol tetraoctanate (40%)/ | none | 1.0 | no | 420 | 40 |
| amino-modified polysiloxane (30%)/ | none | 2.6 | no | 450 | 44 |
| nonylphenol EO adduct (30%) | none | 5.0 | no | 450 | 48 |
| Example 4: | | | | | |
| pentaerythritol tetraoctanate (75%)/ | none | 1.5 | no | 420 | 40 |
| modified silicone composition** (25%): 60% nonylphenol EO adduct: (40%) | none | 3.0 | no | 450 | 45 |
| Comparative Example 1: | | | | | |
| stearyl alcohol EO adduct | none | 3 | much | 350 | 23 |
| Comparative Example 2: | | | | | |
| stearyl alcohol | none | 3 | fair | 410 | 35 |
| $EO_{20}$ adduct (80%)/ | none | 5 | much | 400 | 38 |
| amino-modified polysiloxane (20%) | | | | | |
| Comparative Example 3: | | | | | |
| stearyl alcohol $EO_{20}$ adduct (50%)/ amino-modified polysiloxane (40%) | di(nonylphenyl)-dinonylphenyl phosphite (10%) | 2.5 | fair | 410 | 35 |
| Comparative Example 4: | | | | | |
| isopentacosanyl alcohol $EO_{20}$ adduct (70%)/amino-modified polysilo-xane (25%) | di(nonylphenyl)-dinonylphenyl phosphite (5%) | 2.6 | fair | 407 | 31 |
| Comparative Example 5: | | | | | |
| oleyl alcohol $EO_{20}$ adduct (70%)/amino-modified polysilo- | tetrakis[methylene-3(3,5-di-tert-butyl-4-hydroxy- | 2.5 | fair | 40% | 33 |

TABLE 2-continued

| Composition of Oiling Agent (wt. %) | Antitoxidant (wt. %) | Adhering Amount of Oiling Agent (wt. %) | Evaluation of Tar Attachment | Strand Strength (kg/mm$^2$) | Strength of Bundle (kg) |
|---|---|---|---|---|---|
| xane (25%) | phenyl)propionate] methane (5%) | | | | |
| Comparative Example 6: | | | | | |
| polybutane | none | 3.0 | no | 300 | 15 |

Notes:
* = compounding ratios (by weight) of dipentaerythritol hexalaurate and amino-modified polysiloxane
** = equivalent mixtures of amino-modified silicone, EO-modified silicone and epoxy-modified silicone
amino-modified silicone: viscosity: 500 cp at 25° C.
amino content: 1.0%
EO-modified silicone: viscosity: 500 cp
EO (ethylene oxide) content: 50%
Epoxy-modified silicone: viscosity: 1000 cp
epoxy content: 1.0%

TABLE 3

| | Oiling Agent | Antioxidant | Heat Resistance (°C.) |
|---|---|---|---|
| Example 1 | dipentaerythritol hexalaurate (50%) amino-modified polysiloxane (50%) | none | 290 (355) |
| Example 3 | pentaerythritol tetraoctanate (50%) amino-modified polysiloxane (50%) | none | 295 (355) |
| Comparative Example 1 | stearyl alcohol $EO_{20}$ | none | 170 |
| Comparative Example 2 | stearyl alcohol $EO_{20}$ (80%) amino-modified polysiloxane (20%) | none | 170 (355) |
| Comparative Example 3 | stearyl alcohol $EO_{20}$ (50%) amino-modified polysiloxane (40%) | di(nonylphenyl)-dinonylphenyl phosphite (10%) (10%) | 225 (355) |
| Comparative Example 4 | isopentacosanyl alcohol $EO_{30}$ (70%) amino-modified polysiloxane (25%) | di(nonylphenyl) dinonylphenyl phosphite (5%) (5%) | 210 (355) |
| Comparative Example 5 | oleyl alcohol $EO_{20}$ (70%) amino-modified polysiloxane (25%) | tetrakis[methylene-3(3,5-di-tert-butyl-4-hydroxy-phenyl)propionate]methane (5%) | 255 (355) |

NOTES (1) Method of Evaluation of the Heat Resistance

Of each oiling agent, 10 mg based on the solid component thereof was sampled in a thermobalance, and each sample was heated at a rate of raising the temperature of 2.5° C./minute to obtain a weight reduction curve, from which the temperature at which the weight reduction of the oiling agent (solid component) reached 5% was found. The above Table shows the found temperatures.

(2) The values in parentheses "( )" under Heat Resistance in the above Table show heat resistance values of the silicon component. When mixture oiling agents are subjected to heating treatment, there are shown patterns of reduction in weight proper to respective component oiling agents, that is to say, with respect to the heat resistance, there is no interaction between or among component oiling agents (providing antioxidants tend to more or less enhance the heat resistance of higher alcohol based oiling agents).

We claim:

1. A process for producing an acrylic carbon fiber obtained by heating an acrylic fiber in an oxidizing atmosphere to convert the same into oxidized fiber and heating said oxidized fiber in an inert atmosphere at a higher temperature to carbonize the same, wherein the acrylic fiber is treated with an oiling agent after it is subjected to a water washing step, said oiling agent comprising (a) from 20 to 90% by weight of a neopentyl alcohol derivative represented by the following general formula (I):

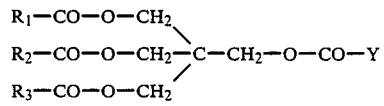

(I)

wherein $R_1$, $R_2$, and $R_3$ are each an alkyl group having 1 to 12 carbon atoms, and Y is an alkyl group having 1 to 12 carbon atoms or is

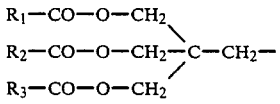

wherein $R_1$, $R_2$, and $R_3$ are each an alkyl group having 1 to 12 carbon atoms, and (b) 10 to 80 wt. % of a modified polysiloxane represented by the following formula (II):

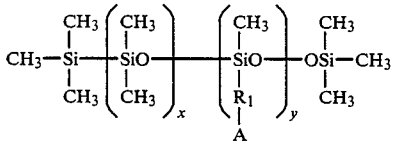

(II)

wherein $R_1$ is an alkylene group having 5 or less carbon atoms or an aryl group, x is an integer of 10 to 1000, y is an integer of 1 to 20, A is

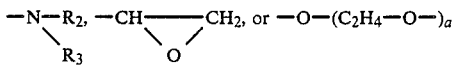

wherein $R_2$ is hydrogen or an alkylene group having 5 or less carbon atoms, $R_3$ is hydrogen or an alkylene or aminoalkyl group each having 5 or less carbon atoms, and a is an integer of 1 to 50.

2. A process for producing an acrylic carbon fiber as claimed in claim 1, wherein the amount of said oiling agent is about 0.5 to 10 wt.% based on the fiber weight.

3. A process for producing an acrylic carbon fiber as claimed in claim 1, wherein said oiling agent further comprises of an anti-static agent, based on the combined weight of the neopentyl alcohol derivative and the modified polysiloxane.

* * * * *